US011859944B1

(12) United States Patent
Burnsed, Jr.

(10) Patent No.: US 11,859,944 B1
(45) **Date of Patent: *Jan. 2, 2024**

(54) SLING SLIDER ELEMENT

(71) Applicant: Blue Force Gear, Inc., Pooler, GA (US)

(72) Inventor: Ashley A Burnsed, Jr., Savannah, GA (US)

(73) Assignee: Blue Force Gear, Inc., Pooler, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/492,639

(22) Filed: Oct. 3, 2021

Related U.S. Application Data

(63) Continuation of application No. 16/895,265, filed on Jun. 8, 2020, now Pat. No. 11,156,434.

(60) Provisional application No. 62/898,162, filed on Sep. 10, 2019.

(51) Int. Cl.
*F41C 33/00* (2006.01)

(52) U.S. Cl.
CPC ..... *F41C 33/002* (2013.01)

(58) Field of Classification Search
CPC ..... F41C 33/002; F41C 33/001; F41C 23/02; A44B 11/12; Y10T 24/12; Y10T 24/4016; Y10T 24/4086; Y10T 24/4077
See application file for complete search history.

(56) References Cited

U.S. PATENT DOCUMENTS 764,065 A * 7/1904 Mitchell ..... A44B 11/18 24/DIG. 28
5,205,021 A * 4/1993 Durand ..... A44B 11/12 24/163 R
5,243,740 A * 9/1993 Wakabayashi ..... A44B 11/02 24/191
6,325,258 B1 * 12/2001 Verdugo ..... F41C 33/002 24/2.5
2001/0032378 A1 * 10/2001 Burt ..... A43C 11/1406 24/307
2008/0302838 A1 * 12/2008 Burnsed, Jr. ..... F41C 23/02 224/150
2010/0125980 A1 * 5/2010 Hede ..... A44B 11/18 24/163 R
2019/0025013 A1 * 1/2019 Lance ..... F41C 33/002

* cited by examiner

*Primary Examiner* — Corey N Skurdal
(74) *Attorney, Agent, or Firm* — Merchant & Gould P.C.

(57) ABSTRACT

A sling slider element has a frame defining an aperture, a rotor pivotally connected to the frame, the rotor received in the frame aperture, the frame and rotor configured to receive a strap, and the rotor movable with respect to the frame between a disengaged position in which the strap is free to slide with respect to the rotor and an engaged position in which the strap is engaged to the frame and rotor. The frame may include a pivot pin spanning the aperture. The frame aperture may be rectangular, and the rotor may be rectangular. The frame may be a planar body, and the rotor may have a planar body portion coplanar with the frame when in the engaged position. The rotor may have a handle element extending away from the planar body portion. The handle element may extend perpendicularly from the planar body portion.

6 Claims, 7 Drawing Sheets

SLING SLIDER ELEMENT

CROSS-REFERENCE TO RELATED APPLICATION

This application is a Continuation of U.S. patent application Ser. No. 16/895,265 filed on Jun. 8, 2020, entitled "SLING SLIDER ELEMENT," which claims the benefit of U.S. Provisional Patent Application No. 62/898,162 filed on Sep. 10, 2019, entitled "PIVOTING SLING ADJUSTOR," which is hereby incorporated by reference in its entirety for all that is taught and disclosed therein.

FIELD OF THE INVENTION

The present invention relates to firearms, and more particularly to a sling slider element that enables the length of a weapon sling to be easily and quickly adjusted.

BACKGROUND OF THE INVENTION

Weapon slings provide many advantages to the user when they are installed on a firearm, such as a rifle or machine gun. First, slings are helpful for carrying a firearm by freeing the user's hands and distributing the firearm's weight more uniformly over the user's body to reduce fatigue. Second, slings can serve as an effective shooting support. Two-point slings have attachment points at both the front and rear of the firearm. These are particularly helpful for facilitating accurate shooting from a variety of positions, including shooting using only one hand, by steadying the attached firearm.

In combat or hunting situations, a user may need to rapidly adjust the length of the weapon sling to change the position of the attached firearm or to remove the weapon sling from his or her body. Conventional sling length adjustment systems can be time consuming or otherwise difficult to operate, especially in high pressure, dangerous situations.

Therefore, a need exists for a new and improved sling slider element that enables the length of a weapon sling to be easily and quickly adjusted. In this regard, the various embodiments of the present invention substantially fulfill at least some of these needs. In this respect, the sling slider element according to the present invention substantially departs from the conventional concepts and designs of the prior art, and in doing so provides an apparatus primarily developed for the purpose of enabling the length of a weapon sling to be easily and quickly adjusted.

SUMMARY OF THE INVENTION

The present invention provides an improved sling slider element, and overcomes the above-mentioned disadvantages and drawbacks of the prior art. As such, the general purpose of the present invention, which will be described subsequently in greater detail, is to provide an improved sling slider element that has all the advantages of the prior art mentioned above.

To attain this, the preferred embodiment of the present invention essentially comprises a frame defining an aperture, a rotor pivotally connected to the frame, the rotor received in the frame aperture, the frame and rotor configured to receive a strap, and the rotor movable with respect to the frame between a disengaged position in which the strap is free to slide with respect to the rotor and an engaged position in which the strap is engaged to the frame and rotor. The frame may include a pivot pin spanning the aperture. The frame aperture may be rectangular, and the rotor may be rectangular. The frame may be a planar body, and the rotor may have a planar body portion coplanar with the frame when in the engaged position. The rotor may have a handle element extending away from the planar body portion. The handle element may extend perpendicularly from the planar body portion. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
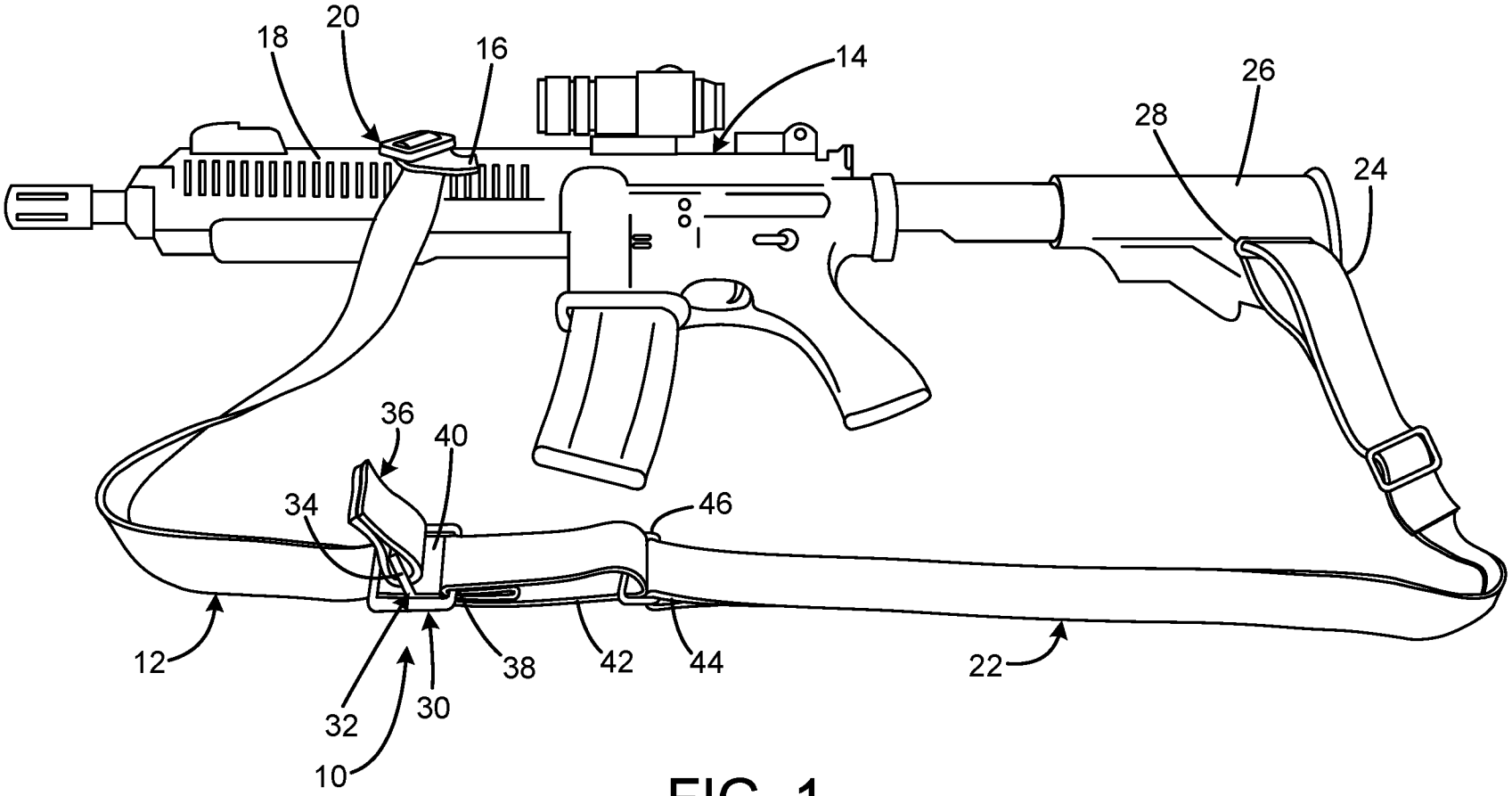
FIG. 1 is a top perspective view of the current embodiment of a sling slider element constructed in accordance with the principles of the present invention in use attached to a weapon sling connected to a rifle.

An embodiment of the sling slider element of the present invention is shown and generally designated by the reference numeral 10.

FIG. 1 illustrates the improved sling slider element 10 of the present invention. More particularly, FIG. 1 shows the sling slider element in use attached to a weapon sling strap 12 connected to a rifle 14. The weapon sling strap has a first end 16 connected to a front portion 18 of the rifle by a rifle engagement element 20. The weapon sling strap has a second strap portion 22 having an opposed end 24 connected to a rear portion 26 of the rifle by a rifle engagement element 28.

The sling slider element 10 has a frame 30 and a rotor 32 pivotally connected to the frame. The rotor 32 includes a handle element 34 with an attached handle 36. The weapon sling strap 12 has a second end 38 connected to the frame, a first intermediate portion 40 passing movably between the frame and the rotor, and a second intermediate portion 42 forming a loop. The second strap portion 22 has a first end 44 slidably engaging the loop via connector 46. The frame and rotor are configured to receive the weapon sling strap. The rotor is movable with respect to the frame between a disengaged position in which the weapon sling strap is free to slide with respect to the rotor and an engaged position in which the weapon sling strap is engaged to the frame and rotor. Sliding of the weapon sling strap with respect to the rotor changes the size of the loop formed by the second intermediate portion, thereby altering the overall length of the weapon sling strap between the rifle engagement element 20 and the rifle engagement element 28.

Figure 2:
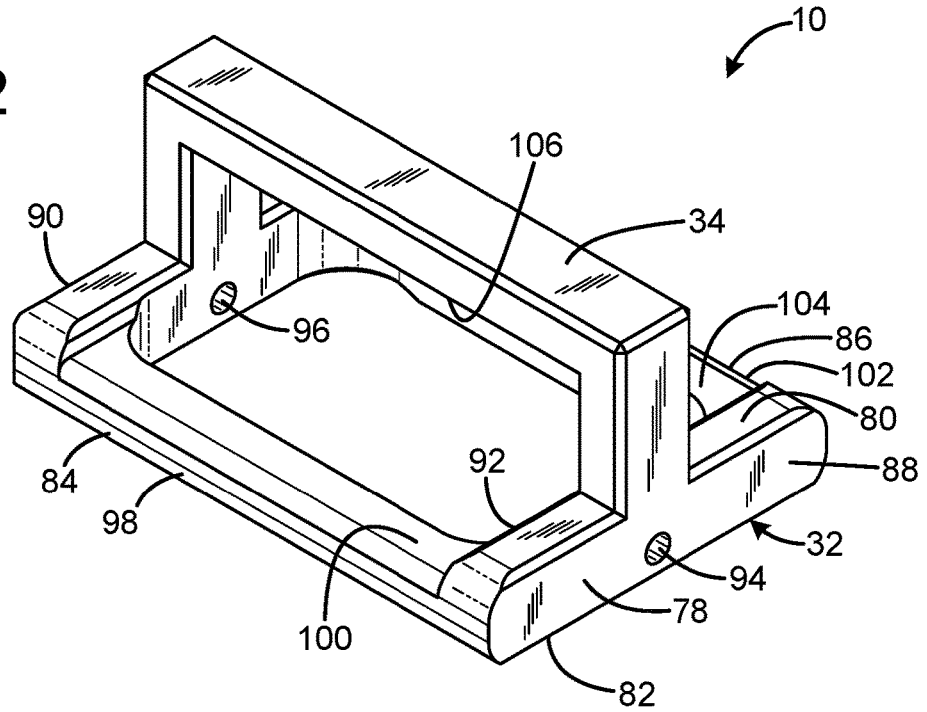
FIG. 2 is an exploded view of the sling slider element of FIG. 1 detached from the weapon sling.
Figure 2:
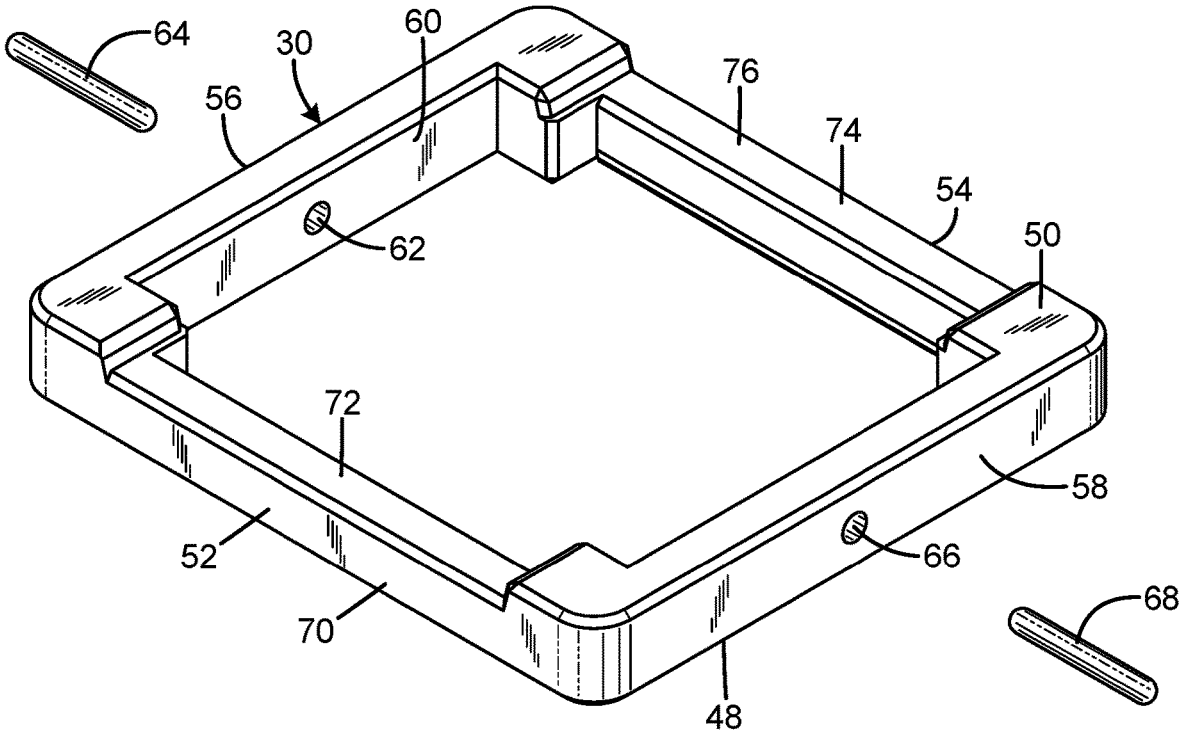

FIG. 2 illustrates the improved sling slider element 10 of the present invention. More particularly, the frame 30 is shown inverted and has a top 48, bottom 50, front 52, rear 54, left side 56, and right side 58. The frame defines an aperture 60, which is rectangular in the current embodiment. The left side defines a pivot pin aperture 62 that receives a pivot pin 64. The right side defines a pivot pin aperture 66 that receives a pivot pin 68. The front of the frame includes a frame strap support bar 70 that defines a recess 72 that receives the weapon sling strap 12. The rear of the frame includes a frame strap support bar 74 that defines a recess 76 that receives the weapon sling strap. The frame strap support bars are opposed, parallel and spaced-apart. In the current embodiment, the frame is a planar body.

The rotor 32 has a planar body portion 78 that is received in the aperture 60 of the frame 30. In the current embodiment, the planar body portion of the rotor is rectangular. The planar body portion has a top 80, bottom 82, front 84, rear 86, left side 88, and right side 90. The planar body portion defines an aperture 92. The left side defines a pivot pin aperture 94 that receives the pivot pin 64 to pivotally connect the left side of the planar body portion to the left side 56 of the frame by spanning the aperture of the frame. The right side defines a pivot pin aperture 96 that receives the pivot pin 68 to pivotally connect the right side of the planar body portion to the right side 58 of the frame by spanning the aperture of the frame. The front of the planar body portion includes a rotor strap support bar 98 that defines a recess 100 that receives the weapon sling strap 12. The rear of the planar body portion includes a rotor strap support bar 102 that defines a recess 104 that receives the weapon sling strap. The rotor strap support bars are opposed and parallel.

The handle element 34 extends away from the top 80 of the planar body portion 78 of the rotor 32. In the current embodiment, the handle element extends perpendicularly from the planar body portion. The handle element includes a handle attachment facility 106 that enables attachment of the handle 36 to the handle element.

Figure 3:
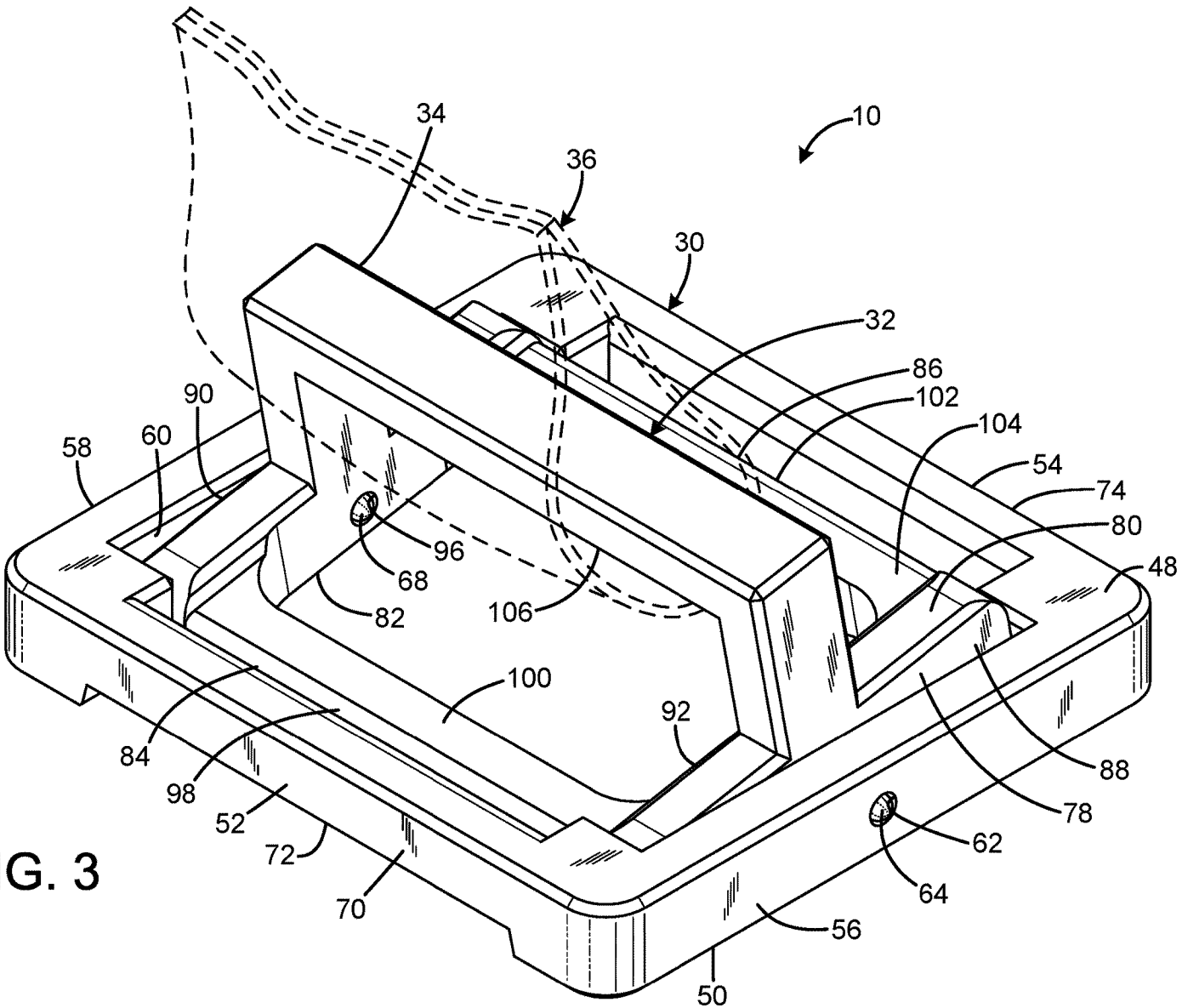
FIG. 3 is a top isometric view of the sling slider element of FIG. 1 detached from the weapon sling with the rotor in one of the two disengaged positions.

FIG. 3 illustrates the improved sling slider element 10 of the present invention. More particularly, the sling slider element is shown with the rotor 32 having been pivoted counterclockwise within the aperture 60 of the frame 30 into one of the two disengaged positions in which the weapon sling strap 12 is free to slide with respect to the rotor to adjust the overall length of the weapon sling strap. The rotor is pivoted clockwise within the aperture of the frame to be placed in the other of the two disengaged positions. Pivoting of the rotor can be accomplished by either pulling on the handle 36 or pushing on the handle element 34 in the desired direction. The top and bottom front edges of the planar body portion 78 of the rotor can be radiused to facilitate operation of the sling slider element.

Figure 4:
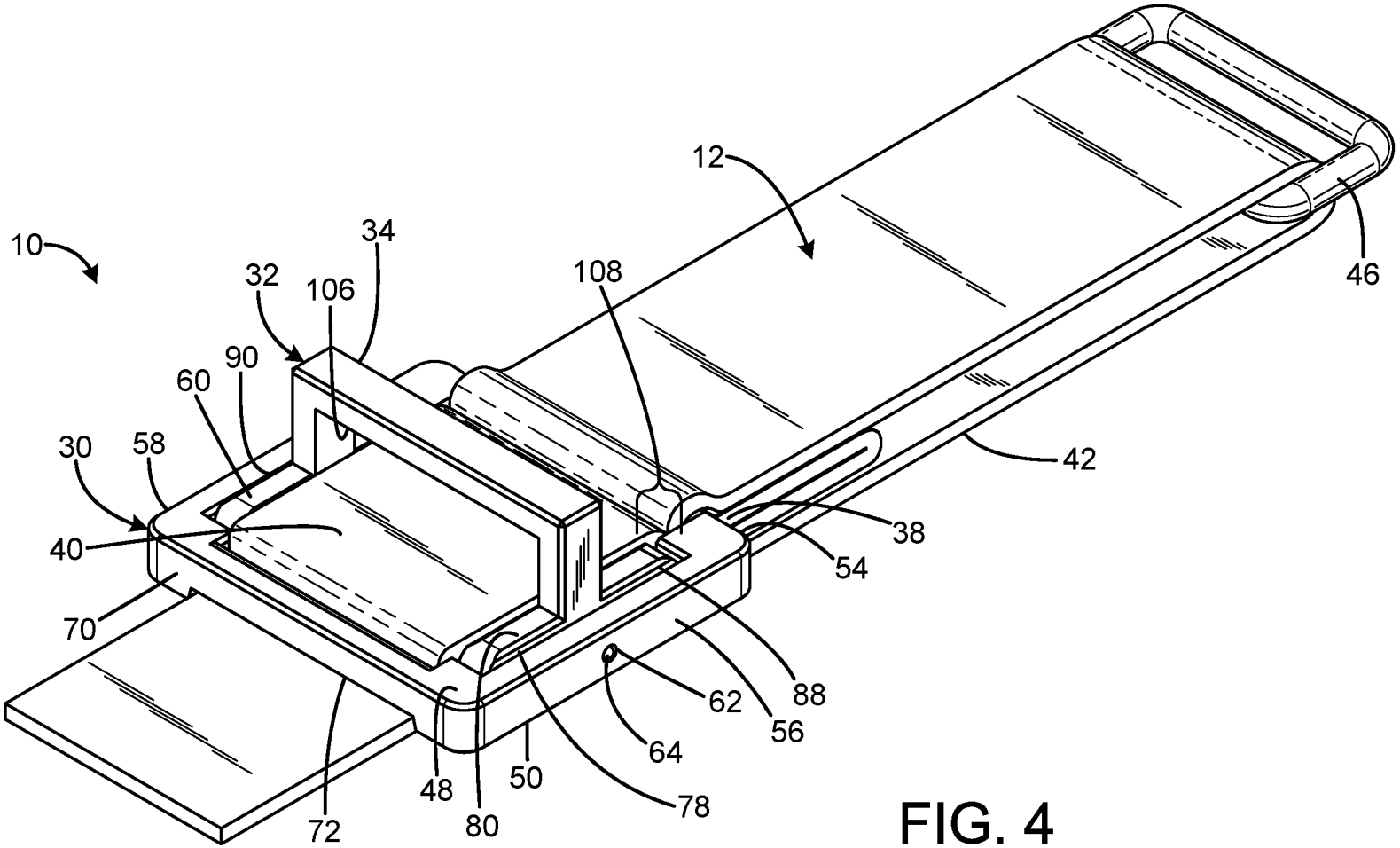
FIG. 4 is a top isometric enlarged view of the sling slider element of FIG. 1 attached to a portion of a weapon sling.

FIG. 4 illustrates the improved sling slider element 10 of the present invention. More particularly, the sling slider element is shown with the rotor 32 in the engaged position in which the weapon sling strap 12 is engaged to the frame 30 and rotor. When the rotor is in the engaged position, the weapon sling strap is prevented from sliding with respect to the rotor, thus maintaining the overall length of the weapon sling strap at a selected amount. The planar body portion 78 of the rotor is coplanar with the frame when the rotor is in the engaged position. It should also be appreciated that the weapon sling strap passes between the planar body portion 78 of the rotor and the handle attachment facility 106.

Figure 5A:
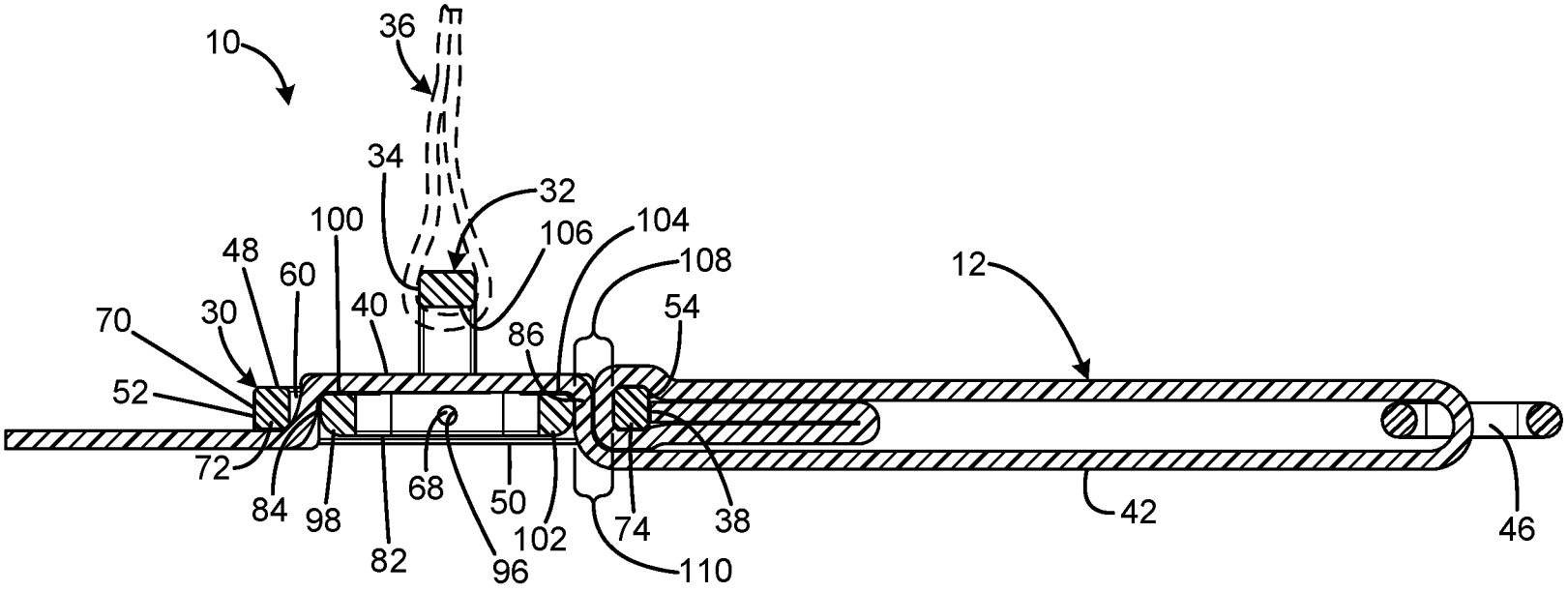
FIG. 5A is a side sectional view of the sling slider element of FIG. 1 attached to a portion of a weapon sling with the rotor in the engaged position.
Figure 5B:
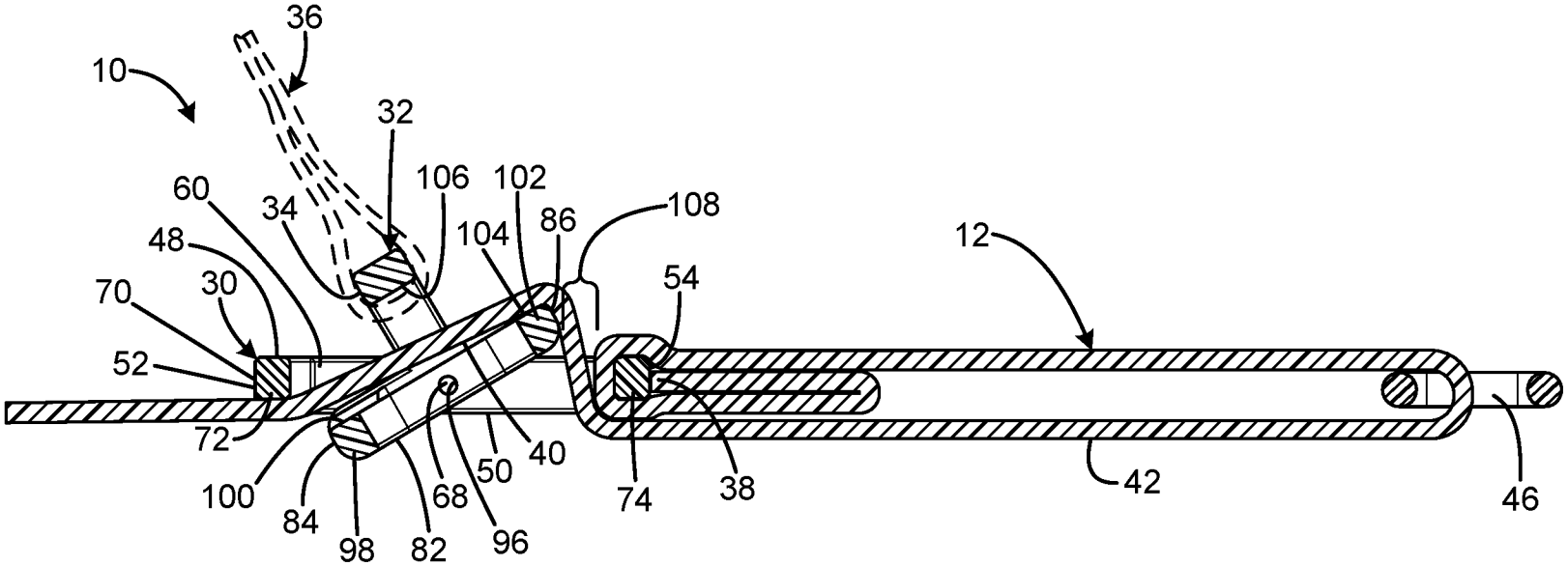
FIG. 5B is a side sectional view of the sling slider element of FIG. 1 attached to a portion of a weapon sling with the rotor in one of the two disengaged positions.
Figure 5C:
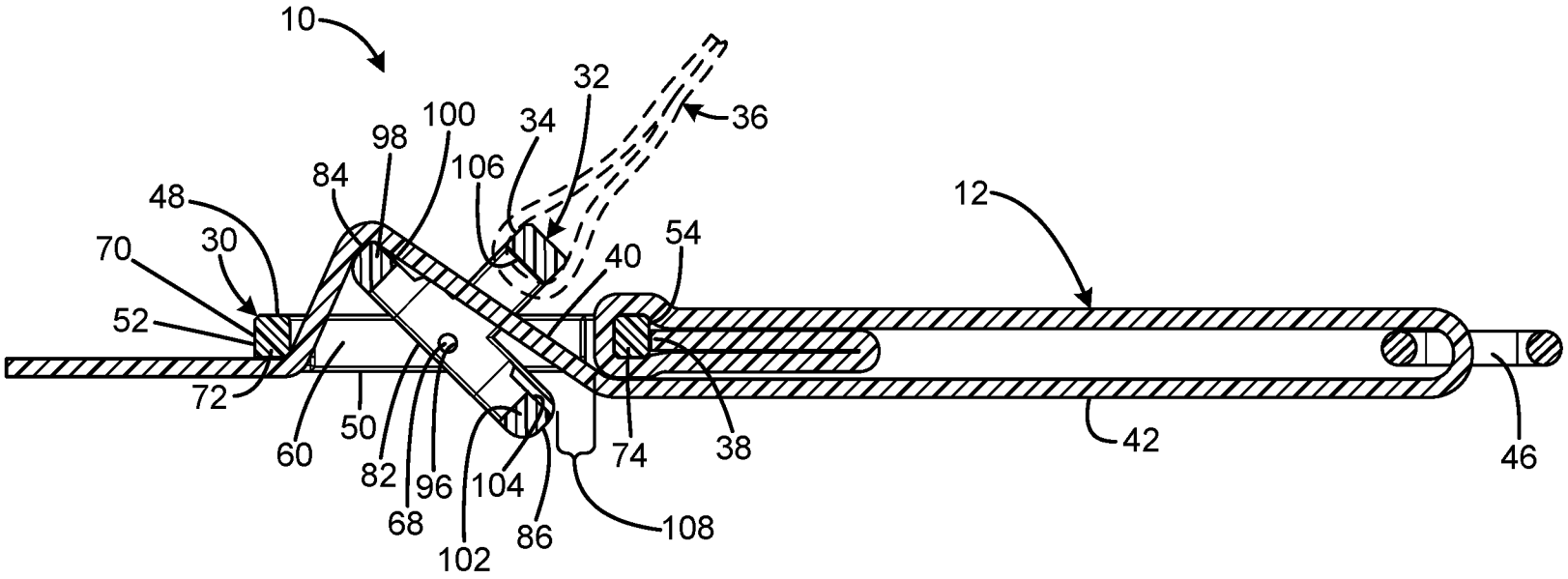
FIG. 5C is a side sectional view of the sling slider element of FIG. 1 attached to a portion of a weapon sling with the rotor in the other of the two disengaged positions.

FIGS. 5A-C illustrate the improved sling slider element 10 of the present invention. More particularly, FIG. 5A shows the rotor 32 in the engaged position, and FIGS. 5B & C show the rotor in the two disengaged positions. The rotor is placed in the two disengaged positions by pivoting the rotor either clockwise or counterclockwise within the aperture 60 of the frame 30. The rotor strap support bars 98, 102 are each proximate and associated frame strap support bar 70, 72 when the rotor is in the engaged position, and the rotor strap support bars are spaced apart from the associated frame strap support bars when the rotor is in the disengaged position. A gap 108 is defined between the rotor strap support bar 102 and the frame strap support bar 74. The width of the gap is adjustable between a narrower condition when the rotor is in the engaged position and a wider condition when the rotor is in one of the two disengaged positions. The weapon sling strap 12 passes on a first side of the frame (bottom 50) and on an opposite side of the planar body portion 78 of the rotor (top 80). It should be appreciated that to thicknesses of the weapon sling strap 110 pass between the frame and the planar body portion of the rotor through the gap between them where the second end 38 of the weapon sling strap connects to the frame. When the rotor is in the engaged position, the two thicknesses of weapon sling strap are pinched together so that the friction between the two thicknesses prevents the weapon sling strap from sliding with respect to the rotor. When the rotor is in one of the two disengaged positions, the gap is widened relative to the engaged position such that the friction between the two thicknesses is lessened sufficiently to permit the weapon sling strap to slide freely with respect to the rotor. The equilibrium state of the rotor is the engaged position when the weapon sling strap is in a state of tension to prevent the weapon sling strap from sliding with respect to the rotor.

While a current embodiment of a sling slider element has been described in detail, it should be apparent that modifications and variations thereto are possible, all of which fall within the true spirit and scope of the invention. Although rifles have been disclosed, the sling slider element is also suitable for use with shotguns, light and medium machine guns, and other firearms. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sling having a slider element comprising:

a frame defining an aperture;

a rotor pivotally connected to the frame;

the rotor received in the frame aperture;

the frame and rotor defining first and second gaps spaced apart from each other and configured to receive a strap;

the strap having a strap segment having end portions passing through the first and second gaps;

the strap segment having a limited length extending directly between the first and second gaps;

the strap having extending portions beyond the segment on an opposite side of the frame; and the rotor movable with respect to the frame between a disengaged position in which the strap is free to slide with respect to the rotor and an engaged position in which the strap is engaged to the frame and rotor, such that the slider may be positioned at a range of different positions along the length of the strap.

2. The sling having a slider element of claim 1 wherein the frame includes a pivot pin spanning the aperture.

3. The sling having a slider element of claim 1 wherein the frame aperture is rectangular, and the rotor is rectangular.

4. The sling having a slider element of claim 1 wherein the frame includes opposed parallel spaced apart frame strap support bars, and the rotor has opposed parallel rotor strap support bars, and wherein at least a selected one of the rotor strap support bars is proximate an associated frame strap support bar when in the engaged position and spaced apart from the associated frame strap support bar when in the disengaged position.

5. The sling having a slider element of claim 1 wherein the strap segment is flat and overlays the rotor.

6. The sling having a slider element of claim 1 wherein the strap segment is a planar body.

* * * * *